US010968705B2

(12) United States Patent
Xu et al.

(10) Patent No.: US 10,968,705 B2
(45) Date of Patent: Apr. 6, 2021

(54) MATRIX BODY PDC DRILL BIT

(71) Applicant: SEED TECHNOLOGIES CORP., LTD., Hunan (CN)

(72) Inventors: Yuehua Xu, Hunan (CN); Bin Liu, Hunan (CN); Zhiming Tang, Hunan (CN)

(73) Assignee: SEED TECHNOLOGIES CORP., LTD., Hunan (CN)

( * ) Notice: Subject to any disclaimer, the term of this patent is extended or adjusted under 35 U.S.C. 154(b) by 1 day.

(21) Appl. No.: 16/266,049

(22) Filed: Feb. 2, 2019

(65) Prior Publication Data

US 2020/0024903 A1 Jan. 23, 2020

(30) Foreign Application Priority Data

Jul. 20, 2018 (CN) ..... 201821160482.7

(51) Int. Cl.
*E21B 10/42* (2006.01)

(52) U.S. Cl.
CPC ..... *E21B 10/42* (2013.01)

(58) Field of Classification Search
CPC ..... E21B 17/02; E21B 17/03; E21B 17/04; E21B 17/046; E21B 10/42
See application file for complete search history.

(56) References Cited

U.S. PATENT DOCUMENTS

| | | | | | |
|---|---|---|---|---|---|
| 5,101,692 | A * | 4/1992 | Simpson | B22D 19/06 | 76/108.2 |
| 5,441,121 | A * | 8/1995 | Tibbitts | B23P 11/025 | 175/417 |
| 6,182,774 | B1 * | 2/2001 | Tibbits | E21B 17/04 | 175/276 |
| 6,945,338 | B1 * | 9/2005 | Defourny | E21B 10/00 | 175/106 |
| 2008/0135304 | A1 * | 6/2008 | Duggan | E21B 10/42 | 175/325.2 |
| 2014/0174827 | A1 * | 6/2014 | Schen | E21B 10/43 | 175/57 |
| 2018/0038171 | A1 * | 2/2018 | Hall | E21B 17/028 | |

* cited by examiner

*Primary Examiner* — Robert E Fuller
(74) *Attorney, Agent, or Firm* — Yue (Robert) Xu; Apex Attorneys at Law, LLP

(57) ABSTRACT

A matrix body PDC drill bit includes a drill crown and a bit body, and further includes a combined limiting sleeve. A connecting block and a connecting sleeve are provided at a junction of the drill crown and the bit body; multiple engaging teeth and engaging grooves for defining circumferential rotation and mutual engagement are provided between the connecting sleeve and the connecting block; the combined limiting sleeve includes several sub-limiting sleeves which are combined and spliced along an outer peripheral surface of the connecting sleeve and are configured to fixedly connected into a whole; an inner side of each sub-limiting sleeve is provided with upper limiting bumps and lower limiting bumps; the connecting block is inserted into the connecting sleeve to allow the upper limiting bumps and the lower limiting bumps to abut against fixed end surfaces of the connecting block and the connecting sleeve, respectively.

8 Claims, 3 Drawing Sheets

MATRIX BODY PDC DRILL BIT

The present application claims the benefit of priority to Chinese patent application No. 201821160482.7 titled "MATRIX BODY PDC DRILL BIT", filed with the Chinese State Intellectual Property Office on Jul. 20, 2018, the entire application of which is incorporated herein by reference.

FIELD

The present application relates to the technical field of drilling equipment, and particularly to a matrix body PDC drill bit.

BACKGROUND

A PDC drill bit is an abbreviation of a polycrystalline diamond compact drill bit, which is a drilling tool commonly used in the geological drilling industry. The PDC drill bit is typically composed of a drill crown and a bit body. The drill crown has several cutting teeth and gauge protection surfaces, and the bit body is connected to a bottom of the drill crown. In view of the material, the PDC drill bit is divided into two types: matrix body PDC drill bits and steel-body PDC drill bits. In order to adapt to manufacture hard materials, the drill crown of the matrix body PDC drill bit is usually processed by a method of sintering tungsten carbide powder or material increasing manufacturing, and the bit body is usually processed by a method of cutting a steel.

Current drill crown and the drill tail of a current matrix body PDC drill bit, however, are usually fixedly integrated by welding or thread. For the matrix body PDC drill bit formed by welding, the strength of the connection at weld seam is weak. In a harsh working condition, the solder of the matrix body PDC drill bit is very easy to fall off due to rotation, erosion and wear, which results in the drill crown detaching from the bit body, thus the service life of the matrix body PDC drill bit formed by welding is still short. As for the matrix body PDC drill bit formed by thread, during the process that the drill pipe drill, the cutting resistance suffered by the matrix body PDC drill bit may easily overcome the connection strength of thread, which results in the connection thread, between the drill crown and the bit body, sliding, thus the service life of the matrix body PDC drill bit formed by thread is much shorter.

Therefore, the current matrix body PDC drill bit has a short service life

SUMMARY

In view of this, an object of the present application is to provide a PCD drill bit that has a longer service life.

A solution is as follows.

A matrix body PCD drill bit is provided in the present application, including a drill crown and a bit body, further including a combined limiting sleeve. A connecting block and a connecting sleeve, which are connected with each other in a sleeve joint manner, are provided at a junction of the drill crown and the bit body; multiple engaging teeth and engaging grooves for defining circumferential relative rotation and engaging with each other are provided between the connecting sleeve and the connecting block; the combined limiting sleeve includes multiple sub-limiting sleeves which are combined and spliced along an outer peripheral surface of the connecting sleeve and are configured to fixedly connect into a whole; an inner side of each sub-limiting sleeve is provided with an upper limiting shoulder and a lower limiting shoulder which are staggered in an axial direction; the connecting block is inserted into the connecting sleeve to allow the upper limiting shoulder and the lower limiting shoulder to abut against fixed end surfaces of the connecting block and the connecting sleeve, respectively.

Preferably, the connecting block is provided at a bottom of the drill crown and the connecting sleeve is provided at a top of the bit body.

Preferably, the height of the connecting block is greater than or equal to the opening depth of the connecting sleeve.

Preferably, the engaging teeth and the engaging grooves are alternately distributed in an annular shape on an outer peripheral surface of the connecting block and an inner side surface of the connecting sleeve.

Preferably, the engaging teeth are embodied as annular-sector-shaped engaging teeth and the engaging grooves are embodied as annular-sector-shaped engaging grooves.

Preferably, the outer peripheral surface of the connecting sleeve is in a cylindrical shape, the combined limiting sleeve comprises two sub-limiting sleeves having semicircular cross sections, and contact surfaces of the two sub-limiting sleeves are fixedly connected into a whole by welding.

Preferably, both the upper limiting shoulder and the lower limiting shoulder are in semi-annular shapes, the upper limiting shoulder are located above the lower limiting shoulder, and the lower limiting shoulder are provided at a bottom end of the sub-limiting sleeves.

Preferably, the width of the upper limiting shoulder in a radial direction is greater than or equal to the thickness of the engaging teeth.

Relative to the background art, the matrix body PDC drill bit, provided by the present application, includes a drill crown and a bit body, and further includes a combined limiting sleeve. A connecting block and a connecting sleeve, which are connected with each other in a sleeve joint manner, are provided at a junction of the drill crown and the bit body; multiple engaging teeth and engaging grooves configured to define circumferential relative rotation and engaged with each other are provided between the connecting sleeve and the connecting block; the combined limiting sleeve includes multiple sub-limiting sleeves which are c combined and spliced along an outer peripheral surface of the connecting sleeve and are configured to fixedly connect into a whole; an inner side of each sub-limiting sleeves is provided with upper limiting shoulder and lower limiting shoulder which are staggered in an axial direction; the connecting block is inserted into the connecting sleeve to allow the upper limiting shoulder and the lower limiting shoulder to abut against fixed end surfaces of the connecting block and the connecting sleeve, respectively.

The connecting block and the connecting sleeve are sleeved with each other and the engaging teeth and engaging grooves, which are engaged with each other, are provided between the connecting sleeve and the connecting block to define the circumferential relative rotation of the connecting block and the connecting sleeve. The connecting block is inserted into the connecting sleeve to allow the upper limiting shoulder and the lower limiting shoulder to respectively abut against fixed end surfaces of the connecting block and the connecting sleeve to define the axial relative movement of the connecting block and the connecting sleeve. Obviously, a stable connection through the connecting sleeve and the connecting block are achieved between the drill crown and the bit body.

Further the combined limiting sleeve includes multiple sub-limiting sleeves which are combined and spliced along an outer peripheral surface of the connecting sleeve and are configured to fixedly connect into a whole, so that the junction between the connecting block and the connecting sleeve relatively becomes thicker, which naturally can withstand greater strength.

It can be seen that the junction between the drill crown and the bit body can achieve double connection to avoid using a single connection, such as welding or thread. Therefore, under the premise of ensuring sufficient cutting strength, the junction between the drill crown and the bit body is stable and can withstand higher strength, and the PDC drill bit has a longer service life.

BRIEF DESCRIPTION OF THE DRAWINGS

For more clearly illustrating the technical solutions in embodiments of the present application or the conventional art, drawings referred to describe the embodiments or the conventional art will be briefly described hereinafter. Apparently, the drawings in the following description are some embodiments of the present application, and for the person skilled in the art, other drawings may be obtained based on these drawings without any creative efforts.

Figure 1:
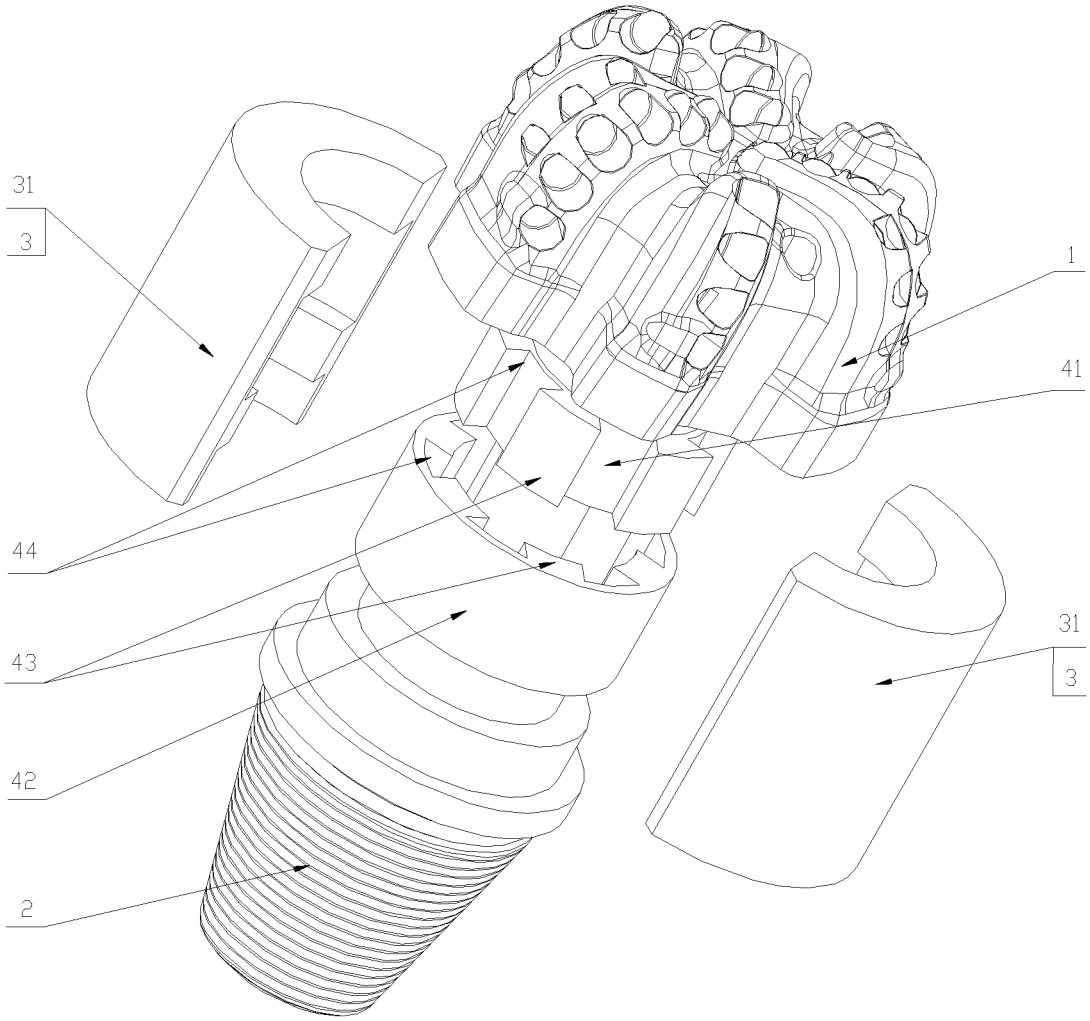
FIG. 1 is a structural exploded view of a matrix body PDC drill bit according to an embodiment of the present application.

Reference Numerals:

| | | | |
|---|---|---|---|
| 1 | drill crown, | 2 | bit body, |
| 3 | combined limiting sleeve, | 31 | sub-limiting sleeve, |
| 311 | upper limiting shoulder, | 312 | lower limiting shoulder, |
| 41 | connecting block, | 42 | connecting sleeve, |

DETAILED DESCRIPTION

The technical solutions according to embodiments of the present application are described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

In order to make the person skilled in the art better understand the present application, the present application will be further described in detail below in conjunction with the accompanying drawings and specific embodiments.

Figure 2:
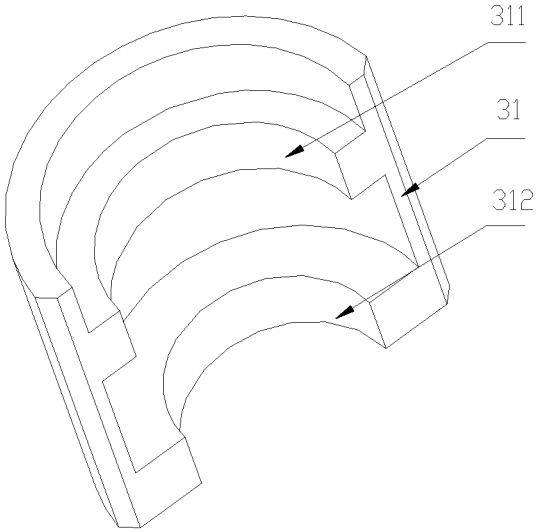
FIG. 2 is a schematic structural diagram of the sub-limiting sleeves in FIG. 1.
Figure 3:
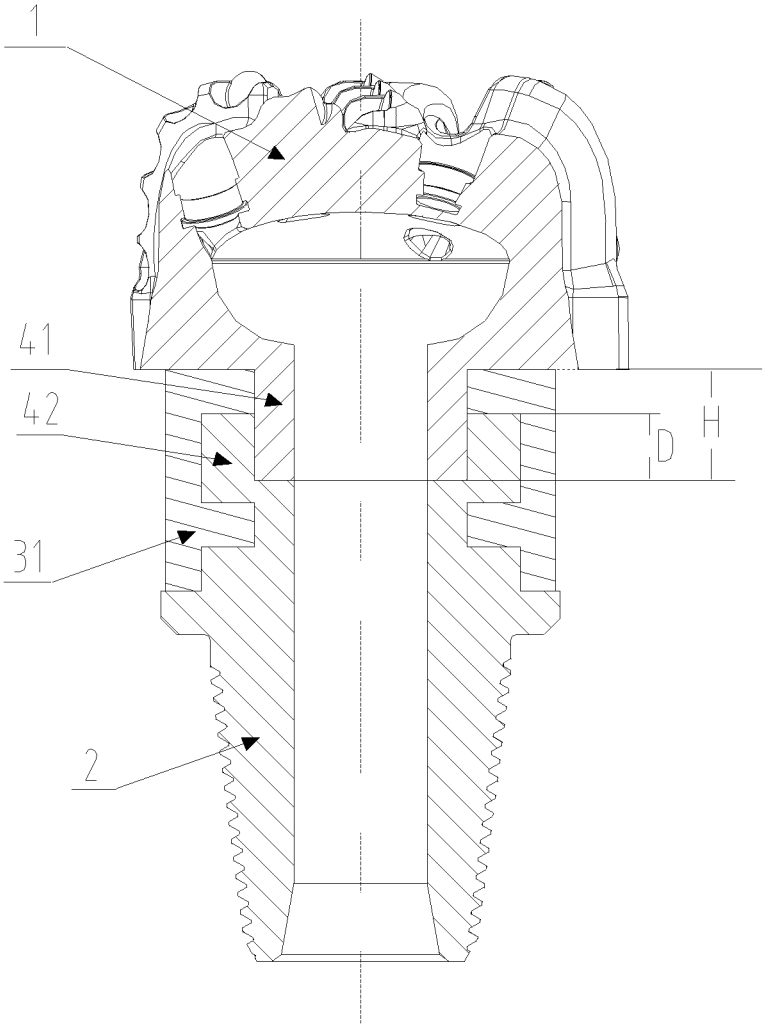
FIG. 3 is a cross-section view of matrix body PDC drill bit in an assembled configuration.

Reference is made to FIG. 1 and FIG. 2. FIG. 1 is a structural exploded view of a matrix body PDC drill bit according to an embodiment of the present application. FIG. 2 is a schematic structural diagram of the sub-limiting sleeves in FIG. 1.

A matrix body PCD drill bit is provided in the present application, including a drill crown 1 and a bit body 2, and further including a combined limiting sleeve 3.

A connecting block 41 and a connecting sleeve 42, which are connected with each other in a sleeve joint manner, are provided at a junction of the drill crown 1 and the bit body 2; in particular, the connecting sleeve 42 has a cavity for accommodating the connecting block 41. Importantly, multiple engaging teeth 43 and engaging grooves 44 for defining circumferential rotation and engaging with each other are provided between the contacting surfaces of the connecting block 41 and the connecting sleeve 42.

In this particular embodiment, preferably, the connecting block 41 is arranged at a bottom of the drill crown 1 and the connecting sleeve 42 is arranged at a top of the bit body 2. And a center of the connecting sleeve 42 has a central cavity that engages with the outer peripheral surface of the connecting block 41. In operation, the connecting block 41 is inserted into the central cavity of the connecting sleeve 42, so that the engaging teeth 43 and the engaging grooves 44 in the connecting block 41 and the connecting sleeve 42 are engaged with each other, which achieves preliminary connection of the drill crown 1 and the bit body 2. Of course, the arrangement positions of the connecting block 41 and the connecting sleeve 42 can be interchanged, which will not affect the object of the present application.

Preferably, in order to ensure that the engaging teeth 43 and the engaging grooves 44 are sufficiently engaged and have sufficient engaging strength, the engaging teeth 43 are embodied as annular-sector-shaped engaging teeth and are extended in an axial direction, furthermore it should ensure that the engaging teeth 43 have a sufficient width and thickness to withstand large torsional moments during operation. Correspondingly, the engaging grooves 44 are embodied as annular-sector-shaped engaging grooves and are extended in an axial direction, and an inner side surface of the engaging grooves 44 are sufficiently engaged with the outer peripheral surface of the engaging teeth 43 to prevent the gap between the outer peripheral surface of the connecting block 41 and the inner side surface of the connecting sleeve 42 from growing too large, and thus affecting the stable operation of the PCD drill bit, which is beneficial to prolong the service life. Of course, the engaging teeth 43 and the engaging grooves 44 may correspond to rectangular teeth and rectangular grooves, or other shapes, depending on the shape of the outer peripheral surface of the connecting block 41 and the shape of the inner side surface of the connecting sleeve 42.

It should be noted that circular-arc-shaped connecting surfaces are further arranged at a junction between one side of the engaging teeth 43 and the connecting block 41 and at a junction between another side of the engaging teeth 43 and the connecting sleeve 42, so as to avoid stress concentration at the junction during a twisting process, which is advantageous to further improve the torsional strength and prolong the service life. Similarly, the circular-arc-shaped connecting surfaces are further arranged at a junction between one side of the engaging grooves 44 and the connecting block 41 and at a junction between another side of the engaging grooves 44 and the connecting sleeve 42, and the effect is the same as the effect of the engaging teeth 43, which will not be described again. In addition, the cross sections of the engaging teeth 43 and the engaging grooves 44 are substantially the same, and naturally, the engaging teeth 43 and the engaging grooves 44 are respectively distributed in an annular shape to further reduce stress concentration and to prolong the service life.

Of course, the engaging teeth 43 and the engaging grooves 44 may also be extended in a direction at a certain angle with the axial direction, which will not affect the object of the present application.

The combined limiting sleeve 3 includes multiple sub-limiting sleeves 31 which are combined and spliced along an outer peripheral surface of the connecting sleeve 42 and are configured to fixedly connect into a whole; an inner side of each sub-limiting sleeve 31 is provided with an upper limiting shoulder 311 and a lower limiting shoulder 312 which are staggered in an axial direction; the connecting block 41 is inserted into the connecting sleeve 42 to allow the upper limiting shoulder 311 and the lower limiting shoulder 312 to respectively abut against fixed end surfaces of the connecting block 41 and the connecting sleeve 42, so as to define the axial relative movement of the connecting block 41 relative to the connecting sleeve 42.

It should be noted that, in this embodiment, the connecting block 41 includes a fixed end connected to the bottom of the drill crown 1 and a free end axially extended relative to the fixed end. Similarly, the connecting sleeve 42 includes a fixed end connected to the top of the bit body 2 and a free end axially extended relative to the fixed end. The upper limiting shoulder 311 and the lower limiting shoulder 312 abut against fixed end surfaces of the connecting block 41 and the connecting sleeve 42, which means that the bottom of the upper limiting shoulder 311 abuts against an end, close to the drill crown, of the connecting block 41, and the top of the lower limiting shoulder 312 abuts against an end, close to the bit body 2, of the connecting sleeve 42.

In this embodiment, the upper limiting shoulder 311 and the lower limiting shoulder 312 respectively abut against the fixed end surfaces of the connecting block 41 and the connecting sleeve 42. At the same time, when the connecting block 41 is inserted into the connecting sleeve 42, the end surface of the fixed end of the connecting block 41 should be higher than the end surface of the free end of the connecting sleeve 42, or flushed with the end surface of the free end of the connecting sleeve 42, otherwise it will cause the connecting block 41 to completely fall into the connecting sleeve 42 and thus the upper limiting shoulder 311 and the lower limiting shoulder 312 fixed in the sub-limiting sleeves 31 cannot abut against the fixed end surface of the connection block 41. That is, the height H of the connecting block 41 is greater than or equal to the depth D of the opening of the connecting sleeve 42.

Preferably, the outer peripheral surface of the connecting sleeve 42 is in a cylindrical shape, correspondingly, the combined limiting sleeve 3 includes two sub-limiting sleeves 31 having semicircular cross sections, and contacting surfaces of the two sub-limiting sleeves 31 are fixedly connected into a whole by welding. Of course, the contacting surfaces of the two sublimit sleeves 31 may be fixedly connected into a whole by thread, which will not affect the object of the present application.

Preferably, both the upper limiting shoulder 311 and the lower limiting shoulder 312 are in semi-annular shapes, the upper limiting shoulder 311 is located above the lower limiting shoulder 312, and the lower limiting shoulder 312 is provided at a bottom end of the sub-limiting sleeves 31. In operation, the upper limiting shoulder 311 abuts against the fixed end surface of the connecting blocks 41. Multiple upper limiting shoulders 311 in sub-limiting sleeves 31 are distributed in an annular shape along the fixed end surface of the connecting block 41, so that the multiple upper limiting shoulders 311 are formed into annular combination compacts that are engaged with the edge of the fixed end surface of the connecting block 41.

Preferably, the axial height between the bottom surface of the upper limiting shoulder 311 and the top surface of the lower limiting shoulder 312 is substantially equal to the axial distance between the two fixed end surfaces of the connecting block 41 and the connecting sleeve 42, so that it is convenient for the bottom surface of the upper limiting shoulder 311 and the top surface of the lower limiting shoulder 312 to respectively be clamped in the corresponding fixed end surfaces of the combined connecting block 41 and connecting sleeve 42, which is convenient for assembly. However, when the axial height between the bottom surface of the upper limiting shoulder 311 and the top surface of the lower limiting shoulder 312 is slightly smaller than the axial distance between the fixed end surfaces of the connecting block 41 and the connecting sleeve 42, an insert thermal process can be used for making the upper limiting shoulder 311 and the lower limiting shoulder 312 correspondingly abut against the two fixed end surfaces of the combined connecting block 41 and connecting sleeve 42. For example, firstly the upper limiting shoulder 311 and the lower limiting shoulder 312 are thermally expanded by inductive heating, so that the axial height between the bottom surface of the upper limiting shoulder 311 and the top surface of the lower limiting shoulder 312 is increased to approximate the axial distance between the two fixed end surfaces of the combined connecting block 41 and the connecting sleeve 42, at the same time, also achieving the assembly. This assembly method can further prevent the axial relative movement between the connecting block 41 and the connecting sleeve 42.

In order to achieve simpler assembly and ensure that the upper limiting shoulder 311 can sufficiently compact the fixed end surface of the connecting block 41, the width of the upper limiting shoulder 311 in a radial direction is greater than or equal to the thickness of the engaging teeth 43. The width of the upper limiting shoulder 311 in the radial direction is an extended distance of the upper limiting shoulder 311 extended from the inner side of the sub-limiting sleeves 31 toward the center of the sub-limiting sleeves 31, and the thickness of the engaging teeth 43 is a distance between the engaging teeth 43 from the outer peripheral surface of the connecting block 41 to the tip of the engaging teeth 43.

In addition, the upper limiting shoulder 311 and the lower limiting shoulder 312 each have a certain thickness, and two ends of the upper limiting shoulder 311 and the lower limiting shoulder 312 correspondingly extend to the two sides of the sub-limiting sleeves 31, respectively, so that the upper limiting shoulder 311 and the lower limiting shoulder 312 have sufficient strength to confront the axial relative movement of the connecting block 41 and the connecting sleeve 42.

When the matrix body PDC drill bit according to the present application is assembled, firstly the connecting block 41 is inserted into the connecting sleeve 42, so that the engaging teeth 43 and the engaging grooves 44 are sufficiently engaged to define the circumferential relative rotation of the connecting block 41 and the connecting sleeve 42; then the sub-limiting sleeves 31 are mounted on the outer peripheral surface of the connecting sleeve 42, so that the upper limiting shoulder 311 and the lower limiting shoulder 312 respectively abut against protruding ends of the connecting block 41 and the connecting sleeve 42; and finally the sub-limiting sleeves 31 are welded.

In summary, the engaging teeth 43 and the engaging grooves 44 are engaged with each other to define the circumferential relative rotation of the connecting block 41 and the connecting sleeve 42, and the upper limiting shoulder 311 and the lower limiting shoulder 312 are cooperated with each other to define the axial relative movement of the connecting block 41 and the connecting sleeve 42, so that a stable connection can be achieved between the drill crown 1 and the bit body 2, and at the same time, the junction between the drill crown 1 and the bit body 2 can withstand higher connection strength, and therefore, the PCD drill according the present application has a longer service life.

Based on the above description of the disclosed embodiments, the person skilled in the art can carry out or use the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A matrix body PDC drill bit, comprising:

a drill crown having a connecting block, a bit body having a connecting sleeve, wherein the connecting block and the connecting sleeve are connected at a junction of the drill crown and the bit body, a plurality of engaging teeth on the connecting block and a plurality of engaging grooves on the connecting sleeve engaging with each other to transfer torque, and a combined limiting sleeve comprising a plurality of sub-limiting sleeves which are fixedly joined by welding to form the combined limiting sleeve, the combined limiting sleeve disposed about an outer peripheral surface of the connecting sleeve;

wherein an inner side of each sub-limiting sleeve is provided with an upper limiting shoulder and a lower limiting shoulder, and the upper limiting shoulder and the lower limiting shoulder are spaced apart along a longitudinal axis of the drill bit; and wherein the connecting block is inserted into the connection sleeve to allow the upper limiting shoulder and the lower limiting shoulder to abut against fixed end surfaces of the connecting block and the connecting sleeve, respectively.

2. The matrix body PDC drill bit according to claim 1, wherein a bottom is defined as a position towards a non-cutting end of the drill bit, and a top is defined as a position towards a cutting end of the drill bit; and the connecting block is arranged at a bottom of the drill crown and the connecting sleeve is arranged at a top of the bit body.

3. The matrix body PDC drill bit according to claim 2, wherein a height of the connecting block is greater than or equal to a depth of an opening of the connecting sleeve.

4. The matrix body PDC drill bit according to claim 2, wherein the plurality of engaging teeth and the plurality of engaging grooves are alternately distributed in an annular shape on an outer peripheral surface of the connecting block and an inner side surface of the connecting sleeve.

5. The matrix body PDC drill bit according to claim 2, wherein the plurality of engaging teeth is embodied as annular-sector-shaped engaging teeth and the plurality of engaging grooves is embodied as annular-sector-shaped engaging grooves.

6. The matrix body PDC drill bit according to claim 1, wherein the outer peripheral surface of the connecting sleeve is in a cylindrical shape, the combined limiting sleeve comprises two sub-limiting sleeves having semicircular cross sections, and contact surfaces of the two sub-limiting sleeves are fixedly connected into a whole by welding.

7. The matrix body PDC drill bit according to claim 6, wherein both the upper limiting shoulder and the lower limiting shoulder are in semi-annular shapes, the upper limiting shoulder is located above the lower limiting shoulder, and the lower limiting shoulder is provided at a bottom end of the sub-limiting sleeves.

8. The matrix body PDC drill bit according to claim 7, wherein a width of the upper limiting shoulder in a radial direction is greater than or equal to a thickness of the engaging teeth.

* * * * *